US007221334B2

(12) United States Patent
Lee et al.

(10) Patent No.: US 7,221,334 B2
(45) Date of Patent: May 22, 2007

(54) ENERGY RECOVERY CIRCUIT OF PLASMA DISPLAY PANEL AND DRIVING APPARATUS OF PLASMA DISPLAY PANEL INCLUDING ENERGY RECOVERY CIRCUIT

(75) Inventors: Jun-Young Lee, Cheonan-si (KR); Byung-Nam An, Asan-si (KR); Jun-Hyung Kim, Cheonan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 637 days.

(21) Appl. No.: 10/829,993

(22) Filed: Apr. 23, 2004

(65) Prior Publication Data

US 2004/0212564 A1 Oct. 28, 2004

(30) Foreign Application Priority Data

Apr. 25, 2003 (KR) ..... 10-2003-0026392

(51) Int. Cl.
*G09G 3/28* (2006.01)

(52) U.S. Cl. ..... 345/60; 315/169.4

(58) Field of Classification Search ..... 345/60, 345/61, 62, 63, 64, 65, 66, 67, 68, 69, 70; 315/169.3, 169.4
See application file for complete search history.

(56) References Cited

U.S. PATENT DOCUMENTS 5,081,400 A * 1/1992 Weber et al. ..... 315/169.4
6,693,608 B2 * 2/2004 Liu et al. ..... 345/60

FOREIGN PATENT DOCUMENTS

JP 07-261701 3/1994

* cited by examiner

*Primary Examiner*—Richard Hjerpe
*Assistant Examiner*—Jean Lesperance
(74) *Attorney, Agent, or Firm*—H.C. Park & Associates, PLC

(57) ABSTRACT

A driving apparatus of a plasma display panel includes an energy recovery circuit. The energy recovery circuit recovers charging/discharging energies of a panel capacitor to a power source supplying unit using a transformer according to charging/discharging operations of the panel capacitor. It includes a first controlling switch, a second controlling switch, and a transformer. The second controlling switch is connected between the panel capacitor and the power source supplying unit and switched according to an external control signal to control the energy recovery from the panel capacitor to the power source supplying unit. The first controlling switch is connected between the panel capacitor and the power source supplying unit and switched according to an external control signal to control the energy recovered in the power source supplying unit to be supplied to the panel capacitor. The transformer is connected between the first controlling switch and the second controlling switch and the panel capacitor so that resonance current flows on a primary inductor by the switching operations of the first controlling switch and the second controlling switch, and induced current induced by the resonance current flowing on a secondary inductor flows to a direction compensating the resonance current through the first controlling switch and the second controlling switch.

14 Claims, 12 Drawing Sheets

ENERGY RECOVERY CIRCUIT OF PLASMA DISPLAY PANEL AND DRIVING APPARATUS OF PLASMA DISPLAY PANEL INCLUDING ENERGY RECOVERY CIRCUIT

BACKGROUND OF THE INVENTION

This application claims the priority of Korean Patent Application No. 2003-26392, filed on Apr. 25, 2003, in the Korean Intellectual Property Office, the disclosure of which is incorporated herein in its entirety by reference.

1. Field of the Invention

The present invention relates to an energy recovery circuit of a plasma display panel and a plasma display panel driving apparatus including the same, and more particularly, to an energy recovery circuit of a plasma display panel, which recovers and supplies charging/discharging energies by operating controlling switches according to charging/discharging operations of a panel capacitor to reduce stress on the controlling switches using a transformer, and a plasma display panel driving apparatus including the energy recovery circuit.

2. Description of the Related Art

FIG. 1 is an inner perspective view of a structure of a plasma display panel in a conventional three-electrodes surface discharging type.

Referring to FIG. 1, address electrode lines $A_{R1}$, $A_{G1}$, . . . , $A_{Gm}$, $A_{Bm}$, dielectric layers 11 and 15, Y electrode lines $Y_1$, . . . , $Y_n$, X electrode lines $X_1$, . . . , $X_n$, a phosphor layer 16, a barrier rib 17, and a magnesium monoxide layer 12 as a passivation layer are disposed between front and rear glass substrates 10 and 13 of a surface discharging plasma display panel 1.

U.S. Pat. No. 5,541,618 discloses an address-display separated driving method which is mainly used as a driving method of the plasma display panel having above structure.

FIG. 2 is a block diagram of a driving apparatus for the plasma display panel shown in FIG. 1.

Referring to FIG. 2, the driving apparatus of the plasma display panel 1 includes an image processing unit 26, a controlling unit 22, an address driving unit 23, X-driving unit 24, and Y-driving unit 25. The image processing unit 26 converts an external analog image signal into a digital signal to generate internal image signals such as image data of red (R), green (G), and blue (B) colors respectively having 8 bits, a clock signal, and vertical and horizontal synchronizing signals. The controlling unit 22 generates driving control signals ($S_A$, $S_Y$, $S_X$) according to the internal image signals from the image processing unit 26. The address driving unit 23 processes the address signal $S_A$ among the driving control signals $S_A$, $S_Y$, $S_X$ from the controlling unit 22 to generate a display data signal, and applies the generated display data signal to address electrode lines. The X-driving unit 24 processes X-driving signal $S_X$ among the driving control signals $S_A$, $S_Y$, $S_X$ from the controlling unit 22, and applies the X-driving signal to X-electrode lines. The Y-driving unit 25 processes Y-driving control signal $S_Y$ among the driving control signals $S_A$, $S_Y$, $S_X$ from the controlling unit 22, and applies the Y-driving control signal $S_Y$ to Y-electrode lines.

FIG. 3 is a timing view showing driving signals applied to the panel shown in FIG. 1 on unit sub-field by the address-display separated driving method.

In FIG. 3, reference numerals $S_{AR1}$, . . . , $A_{Bm}$ denote driving signals applied to respective address electrode lines ($A_{R1}$, $A_{G1}$, . . . , $A_{Gm}$, $A_{Bm}$ in FIG. 1), $S_{X1}$, . . . , $x_n$ denote driving signals applied to the X-electrode lines ($X_1$, . . . , $X_n$ in FIG. 1), and $S_{Y1}$, . . . , $Y_n$ denote driving signals applied to the Y-electrode lines ($Y_1$, . . . , $Y_n$ in FIG. 1).

Referring to FIG. 3, in a reset period (PR) of the unit sub-field (SF), voltages applied to the X-electrode lines $X_1$, . . . , $X_n$, rise continuously from ground voltage to second voltage ($V_S$), for example, to 155 V. Here, ground voltages VG are applied to the Y-electrode lines $Y_1$, . . . , $Y_n$ and the address electrode lines $A_{R1}$, . . . , $A_{Bm}$.

Then, voltages applied to the Y-electrode lines $Y_1$, . . . ,$Y_n$ rise continuously from the second voltage $V_S$, for example, 155V to the highest voltage ($V_{SET}$+$V_S$) which is higher than the second voltage $V_S$ as much as third voltage ($V_{SET}$), for example, to 355V. Here, the ground voltages $V_G$ are applied to the X-electrode lines $X_1$, . . . , $X_n$ and the address electrode lines $A_{R1}$, . . . , $A_{Bm}$.

Next, in a status where the voltages applied to the X-electrode lines $X_1$, . . . , $X_n$ are maintained to be the second voltages $V_S$, the voltages applied to the Y-electrode lines $Y_1$, . . . , $Y_n$ are descended from the second voltage $V_S$ to the ground voltage $V_G$ continuously. Here, the ground voltage $V_G$ are applied to the address electrode lines $A_{R1}$, . . . , $A_{Bm}$.

Accordingly, in a next address period (PA), the display data signals are applied to the address electrode lines and scan signals of ground voltages are sequentially applied to the Y-electrode lines $Y_1$, . . . , $Y_n$ which are biased to be fourth voltages ($V_{SCAN}$) lower than the second voltage $V_S$, and thereby performing smooth addressing operations. The display data signals applied to respective address electrode lines $A_{R1}$, . . . , $A_{Bm}$ are applied with address voltage ($V_A$) of straight polarity in a case where a discharge cell is selected, or applied with ground voltages ($V_G$). Here, the second voltages $V_S$ are applied to the X-electrode lines $X_1$, . . . , $X_n$ for performing the addressing operation more accurately and effectively.

In a next sustain period (PS), display sustain pulses of second voltages $V_S$ are alternatively applied to all Y-electrode lines $Y_1$, . . . , $Y_n$ and to the X-electrode lines $X_1$, . . . , $X_n$ to generate a discharge for maintaining the display on the discharging cells in which wall charges are formed in the corresponding address period (PA).

In the plasma display panel, a voltage higher than discharge starting voltage of the discharged gas should be alternately applied between the sustain electrodes (X electrode and Y electrode) in the discharged cell in driving.

Therefore, in order to apply a positive (+) high voltage and a ground voltage ($V_G$) alternately between the sustain electrodes when the plasma display panel is operating, the panel capacitor should be changed and discharged. Here, the panel capacitor consumes a lot of reactive power in the charging/discharging operations, and a size of the panel capacitor increases in proportion to that of the display panel, thus increasing the power consumption.

To solve the above problem, U.S. Pat. No. 4,866,349 discloses an energy is recovery apparatus for reducing power loss in the charging/discharging operations of the panel capacitor.

FIG. 4 is a circuit diagram of a typical energy recovery apparatus using an external capacitor.

Referring to FIG. 4, the general energy recovery circuit 30 includes an inductor (L1) forming an LC resonance circuit with the panel capacitor (Cp) of the display panel. The energy recovery circuit 30 recovers the energy lost when the panel capacitor Cp is discharged through the inductor L1 and temporarily stores the energy, and uses the stored electric current energy in next charging operation of the panel capacitor Cp. This reduces the reactive power in driving the plasma display panel.

The above circuit is included in the conventional energy recovery apparatus using an external capacitor. The energy recovery apparatus further includes a first energy recovery unit 30 and a second energy recovery unit 40 for maintaining the plasma display panel with the sustain voltage Vs, and for recovering the energy lost in the discharging operation of the panel capacitor Cp to provide the panel capacitor Cp with the retrieved energy in the next charging operation. The first and second energy recovery units 30 and 40 are symmetrically configured as interposing the panel capacitor Cp therebetween.

Also, the first and second energy recovery units 30 and 40 are alternately operated so that the voltages (Vp) on both ends of the panel capacitor Cp change respectively to the anode (+) and the cathode (−) in the charging/discharging operations of the panel capacitor Cp.

In FIG. 4, the first energy recovery unit 30 includes a controlling switch S1 for supplying the sustain voltage $V_S$ to the panel capacitor Cp in the sustain operation of the display panel, the inductor L1 resonated in the charging/discharging operations of the panel capacitor Cp, one-way diodes D15 and D16 to prevent reversal of the resonance current, an external capacitor C1 for storing the energy recovered when the inductor L1 and the panel capacitor Cp are resonated, and controlling switches S11 and S12 connected between the panel capacitor Cp and the external capacitor C1 for switching the energy recovery path.

FIG. 5 is a waveform diagram showing waveforms according to switching operations of respective controlling switches in the energy recovery apparatus shown in FIG. 4.

Referring to FIG. 5, waveforms of voltages on the both ends of the panel capacitor Cp and waveforms of the current flowing on the inductor L1 according to the switching operation of the respective controlling switches in the general energy recovery apparatus are shown as I and II in FIG. 5.

First, the conventional energy recovery apparatus is to reduce the loss of electric power due to the reactive power generated when the charged panel capacitor Cp is discharged after the system power is applied and the plasma display panel is sustained. Also, the energy transfer in the charging/discharging operations of the panel capacitor Cp is made through the resonance operation between the panel capacitor Cp and the inductor L1.

Also, the energy recovery apparatus operates in four sections (T1~T4) as shown in FIG. 5. The second energy recovery unit 40 operates in the same manner as the first energy recovery unit 30. Following is described how the energy recovery unit operates.

The charged energy of the panel capacitor Cp is stored in the external capacitor C1 through the resonance between the inductor L1 and the panel capacitor Cp.

The resonance current i1 of the inductor L1 and the panel capacitor Cp is formed from the external capacitor C1 included in the first energy recovery unit 30, and voltages Vp on both ends of the panel capacitor Cp rise to the sustain voltage $V_S$ by the resonance current i1. Here, the controlling switch S11 is turned on so as to provide the current path (section T1).

Next, the controlling switch S1 is turned on to sustain the plasma display panel, and the sustain voltages are continually applied as the voltages Vp on both ends of the panel capacitor Cp (section T2).

After sustaining the display panel, the inductor L1 and the panel capacitor Cp are resonated in the discharging operation of the panel capacitor Cp so that the charged energy of the panel capacitor Cp is recovered in the outer capacitor C1 of the first energy recovery unit 30. Here, the controlling switch S12 is turned on so as to provide the current path (section T3).

Next, the controlling switch S2 is turned on, and the voltages Vp on both ends of the panel capacitor Cp are maintained at zero electric potential (section T4).

Here, the both ends voltages Vp of the panel capacitor Cp rises from the external capacitor C1 that is charged with the voltage corresponding to half of the sustain voltage Vs to the sustain voltage Vs by the resonance operation of the inductor L1 and the panel capacitor Cp. However, a voltage is actually lost as much as Δ due to a line resistance and other parasitic resistance of devices in the circuit. This lowers energy recovery efficiency and panel driving features due to the discharge before sustaining the display panel.

Therefore, the sustain voltage cannot rise to the desired voltage Vs or cannot be lowered to the ground voltage 0V. When the sustaining operation is performed in this status, the switches for applying and discharging the sustain voltage perform hard-switching operations, creating problems of electromagnetic interference (EMI).

Also, in the conventional energy recovery apparatus, the rising or descending time of the panel voltage is long, thus generating the panel discharge in the energy recovery section. Here, the dropped panel voltage causes a hard-switching operation in applying the sustain voltage at the voltage much less than the sustain voltage. This increases a surge current and stresses the switch.

SUMMARY OF THE INVENTION

The present invention provides an energy recovery circuit of a plasma display panel, which recovers and supplies charging/discharging energies by operating controlling switches according to charging/discharging operations of a panel capacitor and reduces stresses of controlling switches using a transformer, and a driving apparatus of a plasma display panel including the above energy recovery circuit.

According to an aspect of the present invention, there is provided an energy recovery circuit of a plasma display panel, which recovers charging/discharging energies of a panel capacitor to a power source supplying unit using a transformer according to charging/discharging operations of the panel capacitor on a plasma display panel including X-electrode lines and Y-electrode lines formed alternately side by side, discharging cells formed on areas where X and Y-electrode lines and address electrode lines cross each other, and panel capacitors formed between the electrode lines, including a second controlling switch, a first controlling switch, and a transformer.

The second controlling switch may be connected between the panel capacitor and the power source supplying unit and switched according to a controlling signal input from outside to control the energy recovery from the panel capacitor to the power source supplying unit. The first controlling switch may be connected between the panel capacitor and the power source supplying unit and switched according to a controlling signal input from outside to control the energy recovered in the power source supplying unit to be supplied to the panel capacitor. The transformer may be connected between the first and second controlling switches and the panel capacitor so that resonance current flows on a primary inductor by the switching operations of the first and second controlling switches, and induced current induced by the resonance current flowing on a secondary inductor flows to a direction compensating the resonance current through the first and second controlling switches.

According to another aspect of the present invention, there is provided a driving apparatus of a plasma display panel, which recovers charging/discharging energies of a panel capacitor to a power source supplying unit using a transformer according to charging/discharging operations of the panel capacitor for a plasma display panel including X-electrode lines and Y-electrode lines formed alternately side by side, discharging cells formed on areas where X and Y-electrode lines and address electrode lines cross each other, and panel capacitors formed between the electrode lines, including a sustain driving unit and an energy recovery circuit.

The sustain driving unit, of which one end is connected to a power source supplying end of the power source supplying unit, may be switched by an external controlling signal to supply sustain voltage to the panel capacitor so as to sustain the display panel and to discharge the charged power periodically.

The energy recovery circuit may include a second controlling switch, a first controlling switch, and a transformer. The second controlling switch may be connected between the panel capacitor and the power source supplying unit and switched according to a controlling signal input from outside to control the energy recovery from the panel capacitor to the power source supplying unit. The first controlling switch may be connected between the panel capacitor and the power source supplying unit and switched according to a controlling signal input from outside to control the energy recovered in the power source supplying unit to be supplied to the panel capacitor. The transformer may be connected between the first and second controlling switches and the panel capacitor so that resonance current flows on a primary inductor by the switching operations of the first and second controlling switches, and induced current induced by the resonance current flowing on a secondary inductor flows to a direction compensating the resonance current through the first and second controlling switches.

BRIEF DESCRIPTION OF THE DRAWINGS

The above and other features and advantages of the present invention will become more apparent by describing in detail exemplary embodiments thereof with reference to the attached drawings.

DETAILED DESCRIPTION OF THE INVENTION

Hereinafter, the most preferred embodiments of the present invention will be described with reference to accompanying figures in detail.

Figure 1:
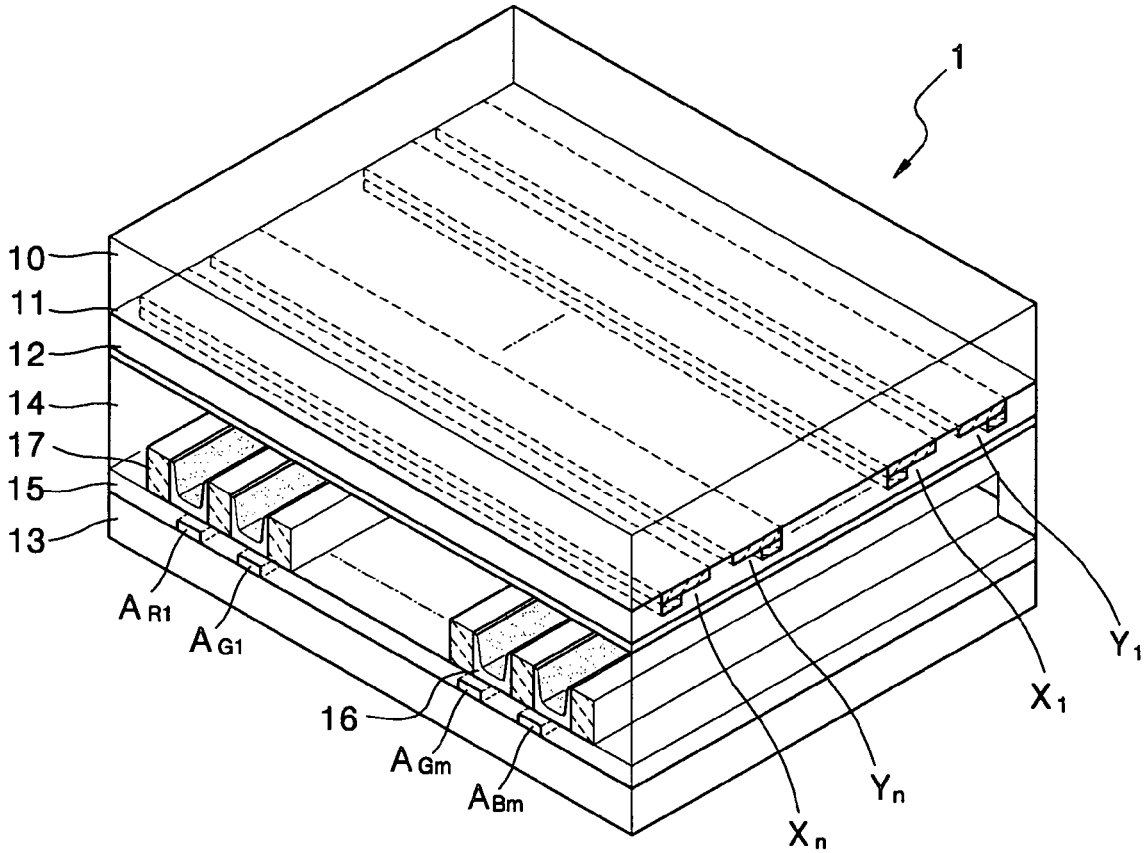
FIG. 1 (PRIOR ART)
FIG. 1 is an inner perspective view of a structure of a plasma display panel of a conventional three-electrode surface discharging type.
Figure 2:
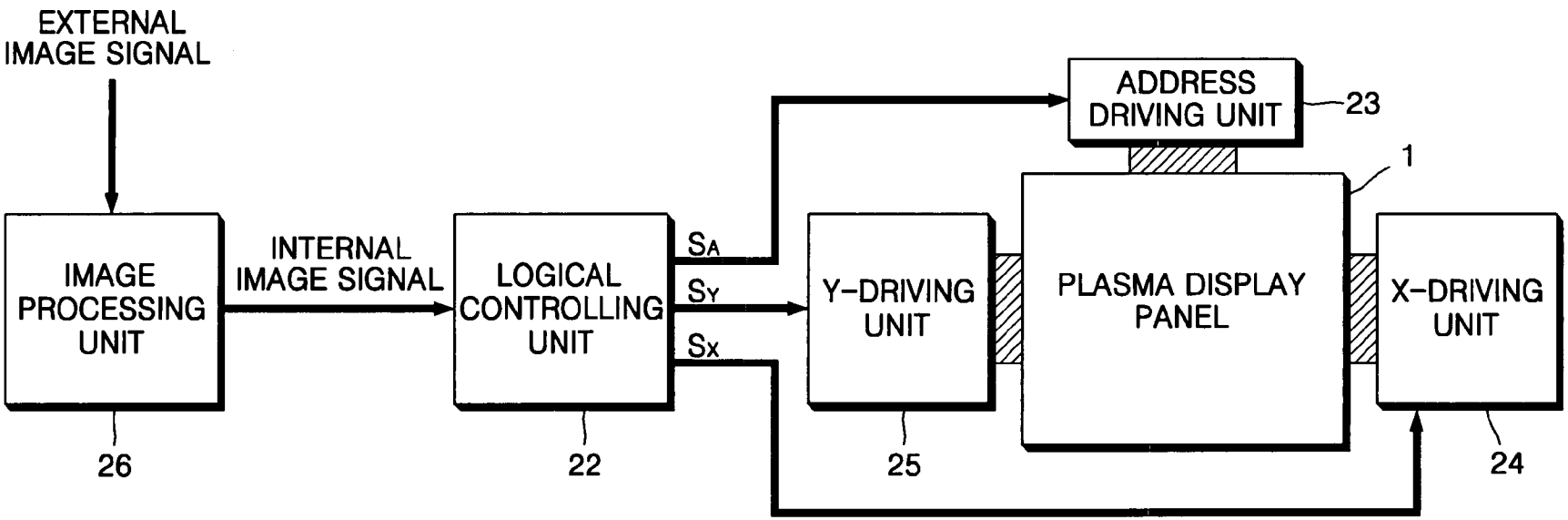
FIG. 2 (PRIOR ART)
FIG. 2 is a block diagram of a general driving apparatus of the plasma display panel shown in FIG. 1.
Figure 3:
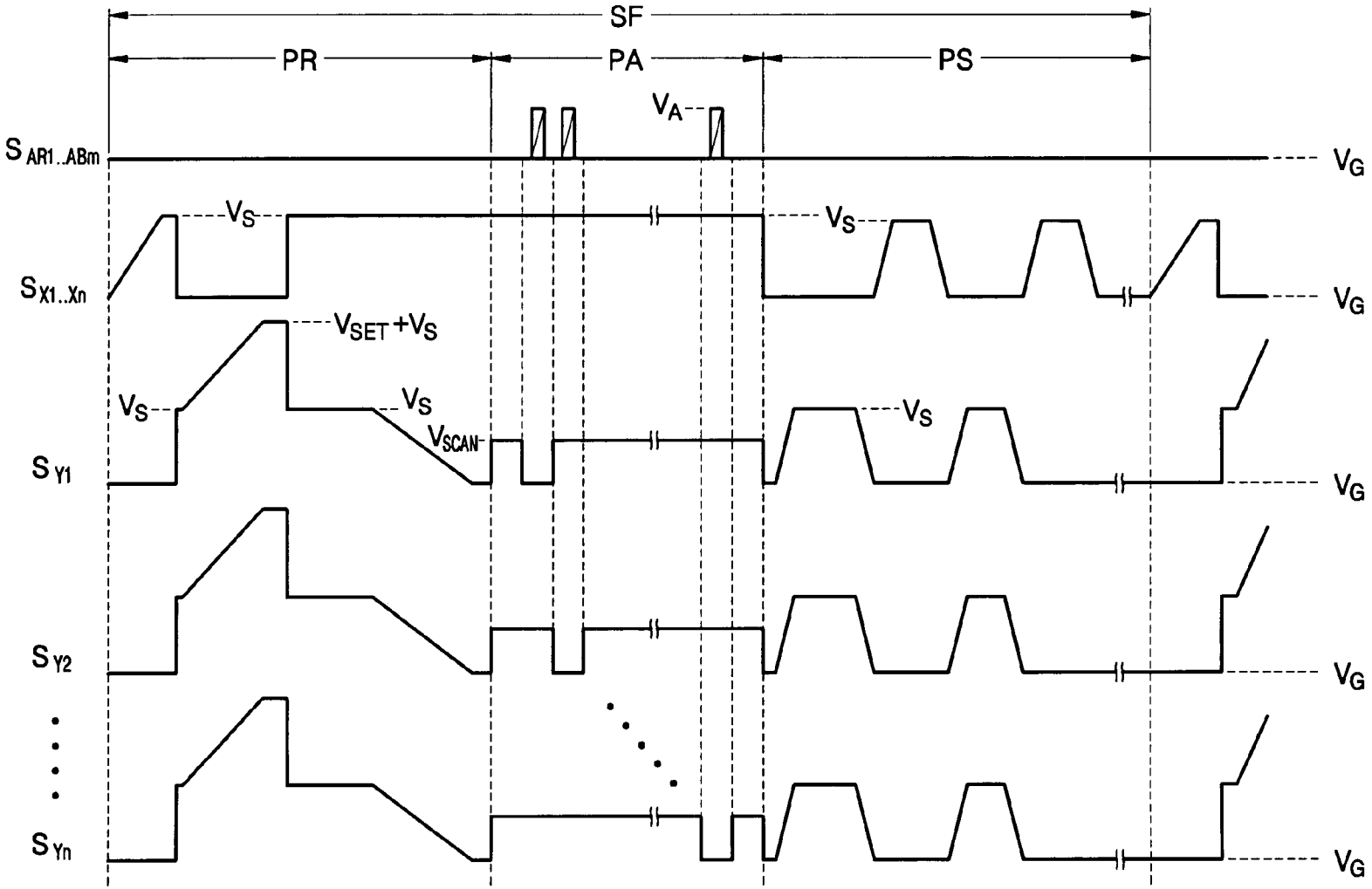
FIG. 3 (PRIOR ART)
FIG. 3 is a timing view showing driving signals applied to the panel of FIG. 1 on a unit sub-field by an address-display separated driving method.
Figure 4:
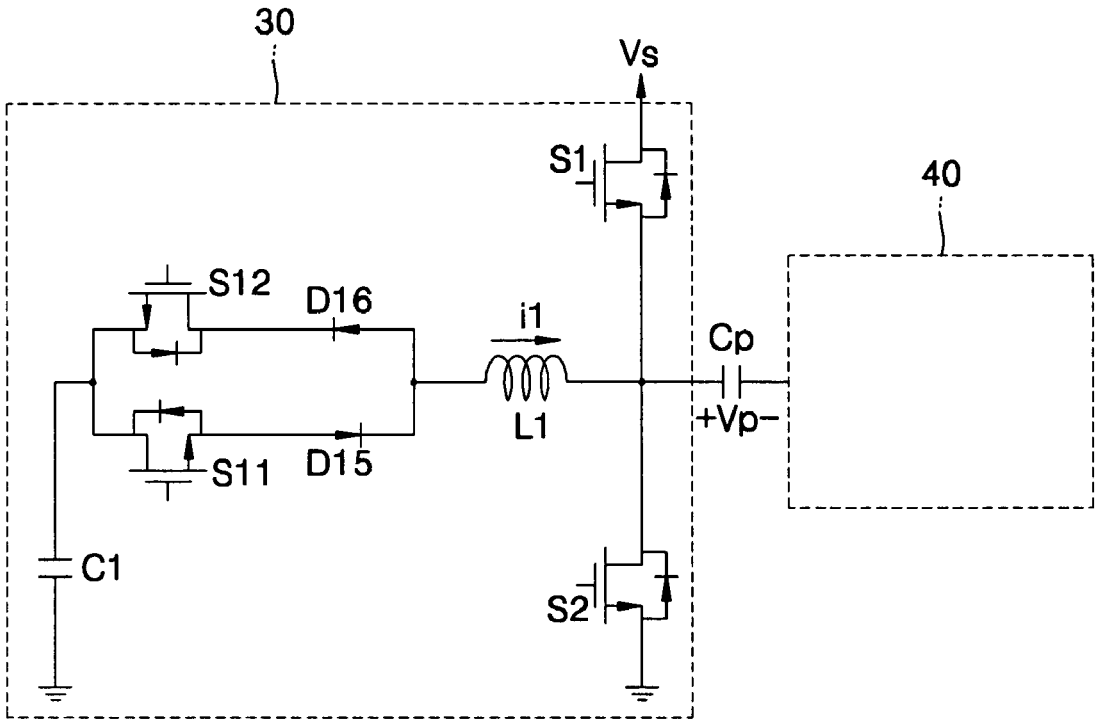
FIG. 4 (PRIOR ART)
FIG. 4 is a schematic circuit diagram of a typical energy recovery apparatus using an external capacitor.
Figure 5:
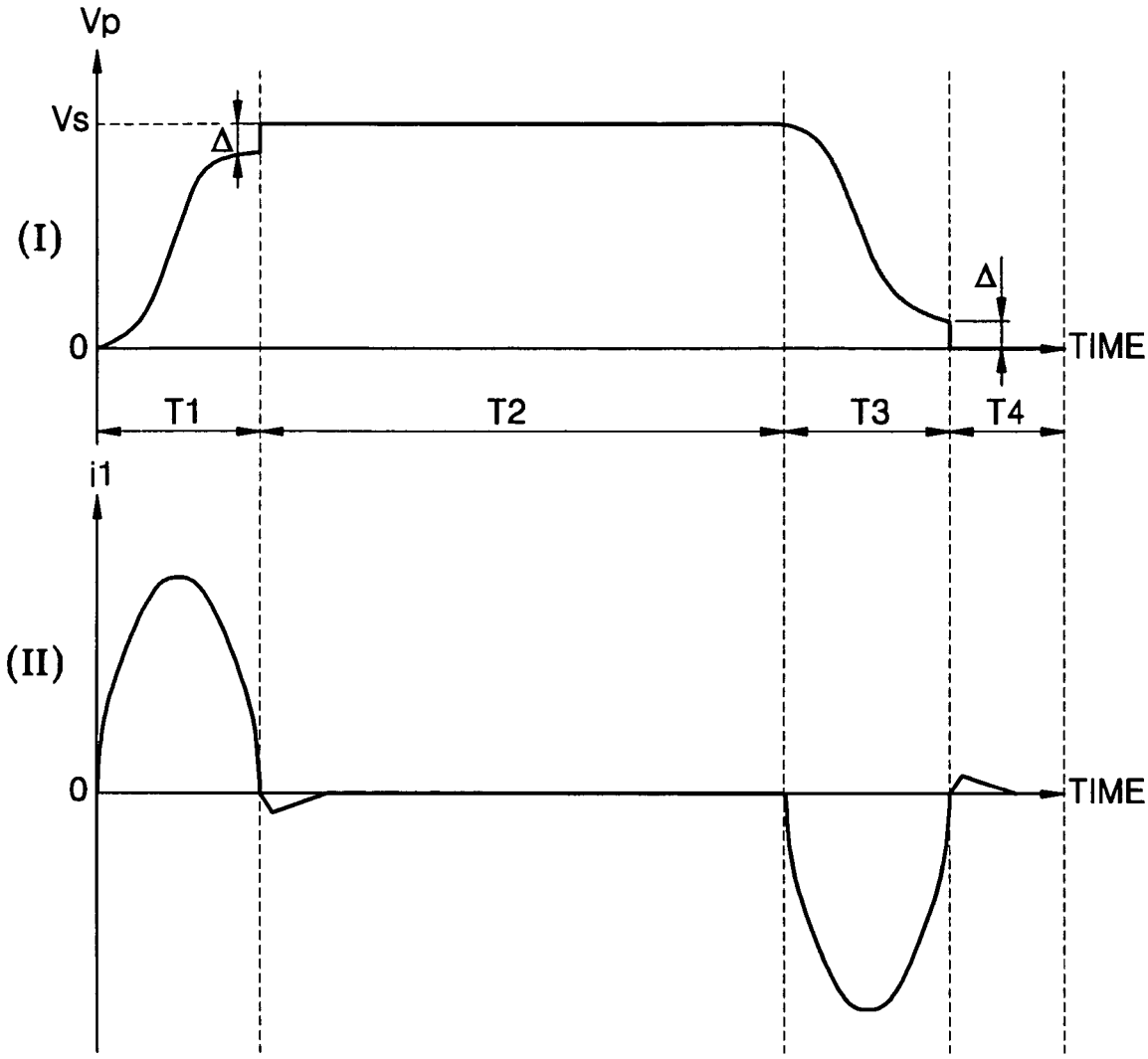
FIG. 5 (PRIOR ART)
FIG. 5 is a diagram showing waveforms according to switching operations of respective controlling switches in the energy recovery apparatus in FIG. 4.
Figure 6:
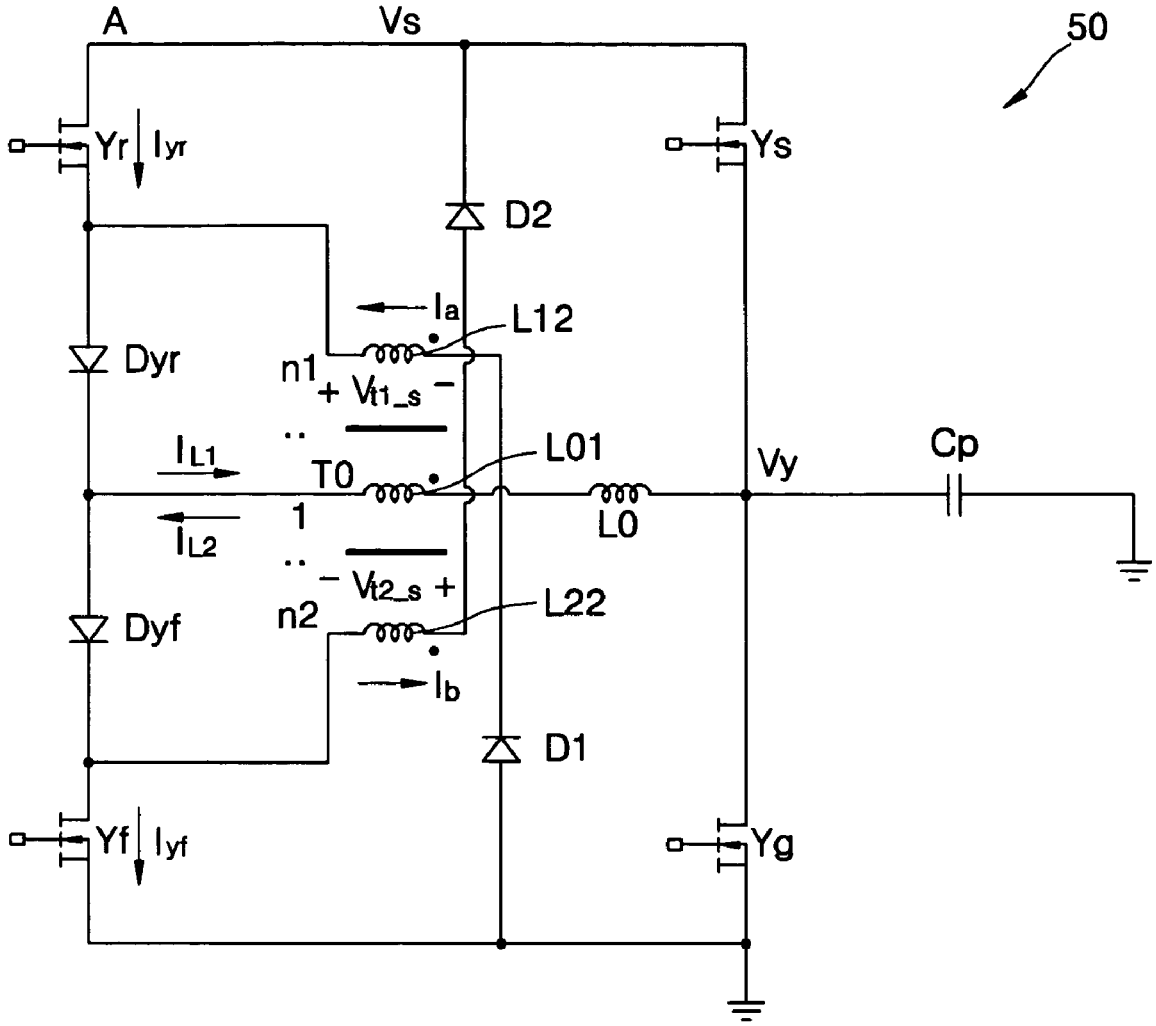
FIG. 6 is a schematic circuit diagram of an energy recovery circuit of a plasma display panel according to an embodiment of the present invention.

FIG. 6 is a circuit diagram schematically showing an energy recovery circuit of a plasma display panel according to an embodiment of the present invention.

Referring to FIG. 6, the energy recovery circuit 50 of the plasma display panel, which recovers charging/discharging energies of a panel capacitor into a power source supplying unit using a transformer T0 according to charging/discharging operations of the panel capacitor Cp, includes a first controlling switch Yr, a second controlling switch Yf, and a transformer T0. The plasma display panel includes X-electrode lines and Y-electrode lines that are alternately formed side by side, discharging cells formed on areas where X and Y-electrode lines and address electrode lines cross each other, and panel capacitors Cp formed between the electrode lines.

The second controlling switch Yf is switched according to an external controlling signal input to control the energy recovery from the panel capacitor Cp to the power source supplying unit, and connected between the panel capacitor Cp and a ground end of the power source supplying unit.

The first controlling switch Yr is switched according to an external controlling signal input to control the recovered energy in the power source supplying unit to the panel capacitor Cp, and connected between the panel capacitor Cp and a power source supplying end (A) of the power source supplying unit.

The transformer T0 is connected between the first controlling switch Yr and the second controlling switch Yf and the panel capacitor Cp so that resonance currents $I_{L1}$ and $I_{L2}$ flow on a primary inductor L01, and induced currents $I_a$ and $I_b$ induced by the resonance currents and flowing on secondary inductors L12 and L22 can flow toward a direction compensating the resonance currents.

It is desirable that a first transformer and a second transformer are disposed as the transformer T0. The first transformer is connected between the first controlling switch Yr and the panel capacitor Cp to reduce the current flowing on the first controlling switch Yr. The second transformer is connected between the second controlling switch Yf and the panel capacitor Cp to reduce the current $I_{yr}$ and $I_{yf}$ flowing on the second controlling switch Yf.

The resonance current $I_{L1}$ flows on the primary inductor L01 according to the switching of the first controlling switch Yr to supply the energy recovered in the power source supplying unit into the panel capacitor Cp, and the induced current $I_a$ induced by the resonance current $I_{L1}$ flows on the secondary inductor L12. Here, the induced current $I_a$ flows toward the direction compensating the resonance current $I_{L1}$ through the first controlling switch Yr, and a differential current ($I_{yr}$) between the resonance current $I_{L1}$ and of the induced current $I_a$ flows on the first controlling switch Yr.

Therefore, the induced current $I_a$ is formed to flow toward the opposite direction of the resonance current $I_{L1}$ on the first controlling switch Yr using the transformer, thus reducing current stress due to the current $I_{yr}$ flowing on the first controlling switch Yr.

The resonance current $I_{L2}$ flows on the primary inductor L01 due to the switching operation of the second controlling switch Yf to recover the energy of the panel capacitor Cp to the power source supplying unit, and the induced current $I_b$ which is induced by the resonance current $I_{L2}$ flows on the secondary inductor L22. Here, the induced current $I_b$ flows toward a direction compensating the resonance current $I_{L2}$ through the second controlling switch Yf, thus the differential current $I_{yf}$ between the resonance current $I_{L2}$ and the induced current $I_b$ flows on the second controlling switch Yf. Therefore, the current stress due to the current $I_{yf}$ flowing on the second controlling switch Yf can be reduced by making the induced current $I_b$ flow to the opposite direction of the resonance current $I_{L2}$ on the second controlling switch Yf using the transformer.

Here, the primary inductor of the first transformer and the primary inductor of the second transformer are used commonly as the primary inductor L0. The common primary inductor L0, the secondary inductor L12 of the first transformer, and the secondary inductor L22 of the second transformer can form one transformer T0. Therefore, one transformer including three inductors can be used instead of using two transformers including two inductors, thus reducing the number of required devices and simplifying the circuit.

It is desirable that a resonance inductor L0 is connected between the panel capacitor Cp and the transformer T0 to form paths of recovering and supplying the charging/discharging energies of the panel capacitor Cp. That is, an additional resonance inductor L0 is connected between the primary inductor L01 of the transformer T0 and the panel capacitor Cp, and the resonance inductor L0 is disposed as separated from the transformer to store the current energy recovered from the panel capacitor and the current energy supplied to the panel capacitor primarily.

One end of the first controlling switch Yr is connected to a power source supplying end A of the power source supplying unit, and the other end of the first controlling switch Yr is connected to one end of the primary inductor L01 of the transformer T0 through the diode Dyr. The other end of the primary inductor L01 of the transformer T0 is connected to one end of the resonance inductor L0, and the other end of the resonance inductor L0 is connected to the panel capacitor Cp.

Therefore, when the first controlling switch Yr is turned on, the resonance current $I_{L1}$ flows on the current path formed by the power source supplying end A, the first controlling switch Yr, a diode Dyr, the primary inductor L01 of the transformer T0, the resonance inductor L0, and the panel capacitor Cp to supply the energy recovered in the power source supplying unit to the panel capacitor Cp. Here, the diode Dyr is for restraining the current from flowing reverse direction of the resonance current $I_{L1}$.

One end of the secondary inductor L12 of the transformer T0 is connected to the other end of the first controlling switch Yr, and the other end of the secondary inductor L12 is grounded to a reference potential through a diode D1. Therefore, the induced current $I_a$ flowing on the secondary inductor L12 by the inducement of the resonance current $I_{L1}$ flowing on the primary inductor L01 of the transformer T0 can be flowed on a current path formed by the ground end, the diode D1, the secondary inductor L12, the first controlling switch Yr, and the power source supplying end A.

Here, the direction of the induced current $I_a$ flowing on the first controlling switch Yr is opposite to the resonance current $I_{L1}$, and first switch current $I_{yr}$ flowing on the first controlling switch Yr is the differential current between the resonance current $I_{L1}$ and the induced current $I_a$. Therefore, the current stress applied to the first controlling switch Yr is reduced.

One end of the second controlling switch Yf is connected to the ground end of the power source supplying unit, and the other end of the second controlling switch Yf is connected to one end of the primary inductor L01 of the transformer through the diode Dyf. The other end of the primary inductor L01 of the transformer T0 is connected to one end of the resonance inductor L0, and the other end of the resonance inductor L0 is connected to the panel capacitor Cp.

Therefore, when the second controlling switch Yf is turned on (ON), the resonance current $I_{L2}$ flows on a current path formed by the panel capacitor Cp, the resonance inductor L0, the primary inductor L01 of the transformer T0, the diode Dyf, the second controlling switch Yf, and the ground end to recover the energy of the panel capacitor Cp into the power source supplying unit. Here, the diode Dyf is for restraining the current from flowing reverse to the direction of the resonance current $I_{L2}$.

One end of the secondary inductor L22 of the transformer T0 is connected to the other end of the second controlling switch Yf, and the other end of the secondary inductor L22 is connected to the power source supplying end through a diode D2. Therefore, the induced current $I_b$ flowing on the secondary inductor L22 by the inducement of the resonance current $I_{L2}$ flowing on the primary inductor L0 of the transformer T0 can flow on a current path formed by the ground end, the second controlling switch Yf, the secondary inductor L22, the diode D2, and the power source supplying end A.

Here, the direction of the induced current $I_b$ flowing on the second controlling switch Yf is opposite of the resonance current $I_{L2}$, and thus second switch current $I_{yf}$ flowing on the second controlling switch Yf is the differential current between the resonance current $I_{L2}$ and the induced current $I_b$. Therefore, the current stress to the second controlling switch Yf can be reduced.

Figure 7:
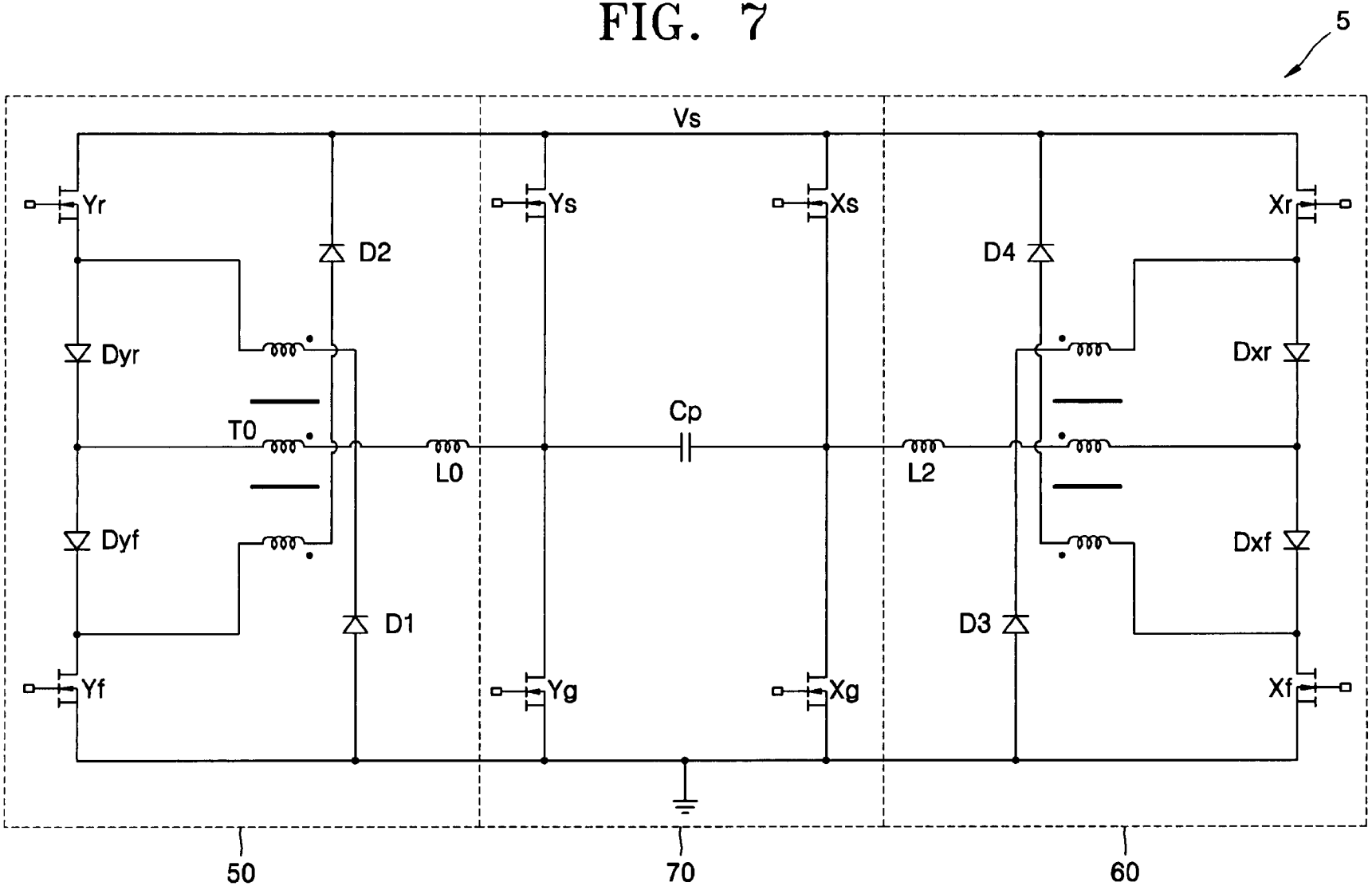
FIG. 7 is a schematic circuit diagram of a driving apparatus of the plasma display panel including the energy recovery apparatus of FIG. 6.

FIG. 7 is a circuit diagram of a driving apparatus of the plasma display panel including the energy recovery circuit of FIG. 6.

Referring to FIG. 7, the driving apparatus 5 of the plasma display panel includes a sustain driving unit 70 and energy recovery circuits 50 and 60. The driving apparatus 5 according to the present embodiment includes the energy recovery circuit 50 of FIG. 6. The same reference numerals are used for the same components and detailed descriptions thereof will be omitted.

The sustain driving unit 70 having one end connected to the first power source supplying end A is switched according to an external controlling signal to supply sustain voltage to the panel capacitor Cp so as to sustain the display panel, and discharges the charged electric power periodically.

The sustain driving unit 70 includes a first switch Ys and a second switch Yg connected to each other and commonly connected to Y-electrode lines, and a third switch Xs and a fourth switch Xg connected to each other and commonly connected to the X-electrode lines.

The energy recovery circuits 50 and 60 are a first energy recovery circuit 50 and a second energy recovery circuit 60 which are connected to both ends of the panel capacitor symmetrically. In the present embodiment, these are connected to the sustain driving unit, the is first energy recovery circuit 50 is connected to the Y-electrode driving unit, and the second energy recovery circuit 60 is connected to the X-electrode driving unit. Hereinafter, the energy recovery circuit will be described based on the first energy recovery circuit driving the Y-electrode lines, since the second energy recovery circuit 60 functions same as the first energy recovery circuit 50.

Figure 8:
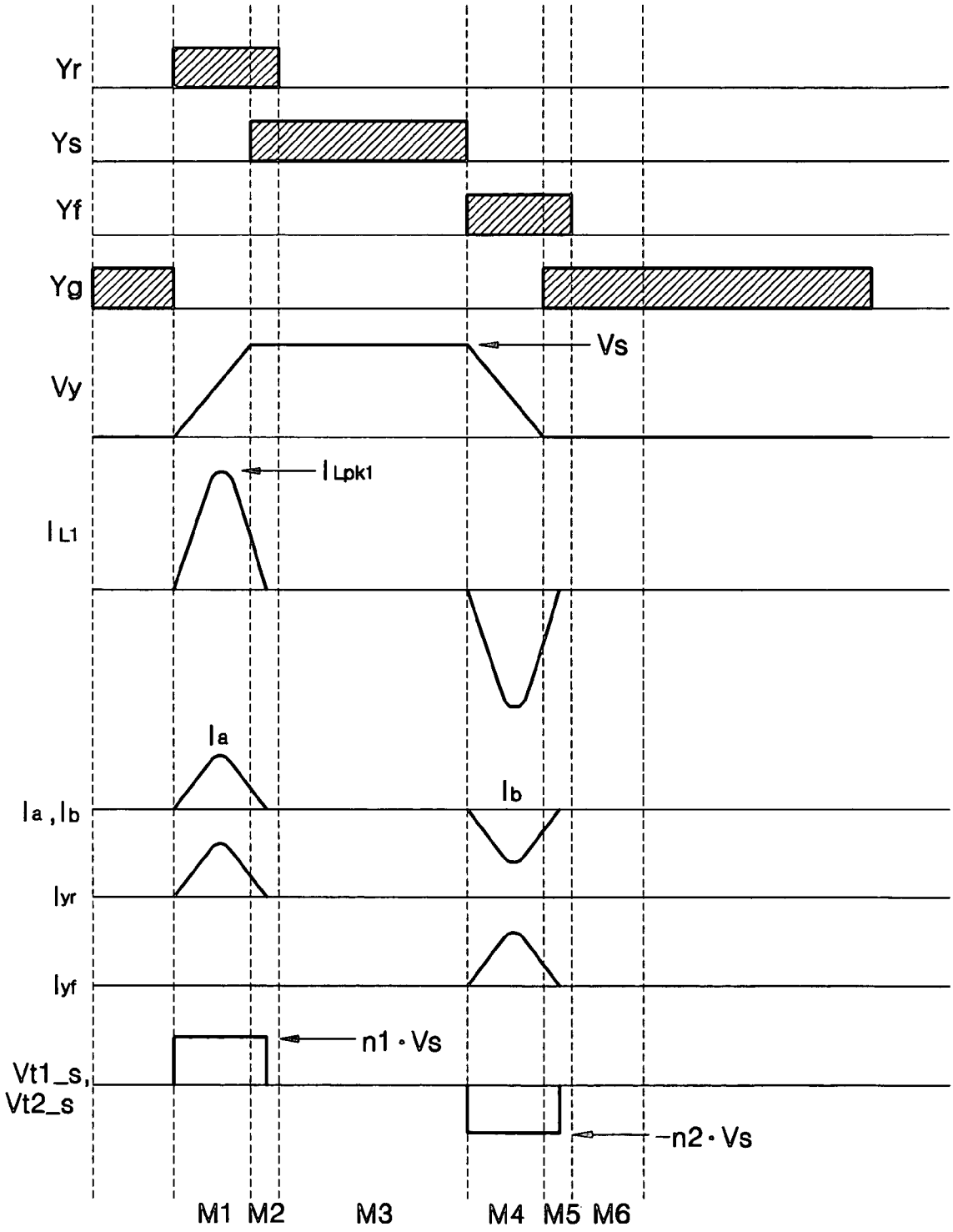
FIG. 8 is a view showing waveforms according to switching operations of respective controlling switches in the driving apparatus of the plasma display panel of FIG. 7.

FIG. 8 is a view of waveforms according to switching operations of the respective controlling switches in the driving apparatus of the plasma display panel shown in FIG. 7. FIGS. 9A, 9B, 9C, 9D, 9E and 9F are circuit diagrams of current flowing on respective steps when operating the driving apparatus of the plasma display panel.

Referring to FIGS. 9A, 9B, 9C, 9D, 9E and 9F, a method for recovering the energy in the driving apparatus 5 of the plasma display panel includes step 1 through step 6 (M1, . . . ,M6). Also, switching signals are applied to respective first switch Ys, the second switch Yg, the first controlling switch Yr, and the second controlling switch Yf in respective steps. Each of the figures show the step from M1 through M6 respectively.

Figure 9A:
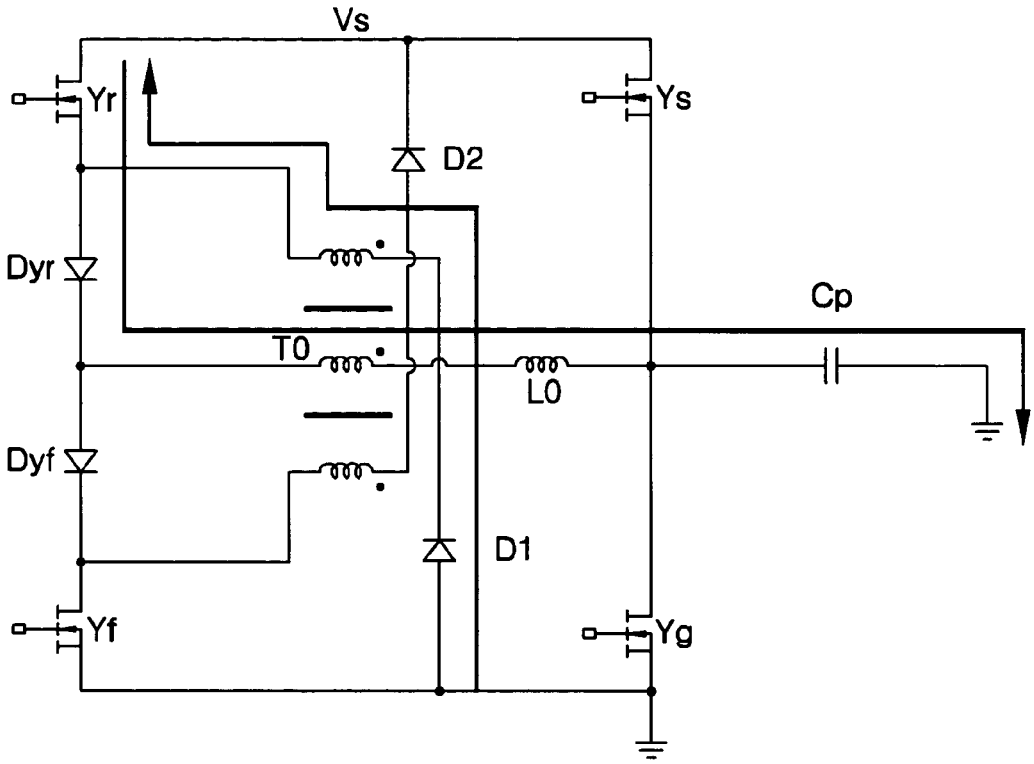
FIGS. 9A, 9B, 9C, 9D, 9E and 9F are circuit diagrams showing current flowing on respective sections when operating the driving apparatus of the plasma display panel of FIG. 8.

In step 1(M1), the first controlling switch Yr is turned on. Accordingly, when the first controlling switch Yr is continued, Vs is applied to the primary inductor L01 of the transformer T0 from the power source supplying end A. In addition, the resonance current $I_{L1}$ flows on the current path formed by the power source supplying end A, the first controlling switch Yr, the diode Dyr, the primary inductor L01 of the transformer T0, the resonance inductor L0, and the panel capacitor Cp to supply the energy recovered in the power source supplying unit to the panel capacitor Cp. Here, the panel voltage Vy rises from a reference potential (GND) to the potential Vs of the power source supplying unit (FIG. 9A).

Accordingly, voltage of n1*Vs is induced into the secondary inductor L12 of the transformer T0, and the induced current $I_a$ flowing on the secondary inductor L12 flows on the current path formed by the ground end, the diode D1, the secondary inductor L12, the first controlling switch Yr, and the power source supplying end A. Here, since the differential current between the resonance current $I_{L1}$ and the induced current $I_a$ flows on the first controlling switch Yr, the current stress applied on the first controlling switch Yr can be reduced as much as the induced current $I_a$.

Figure 9B:
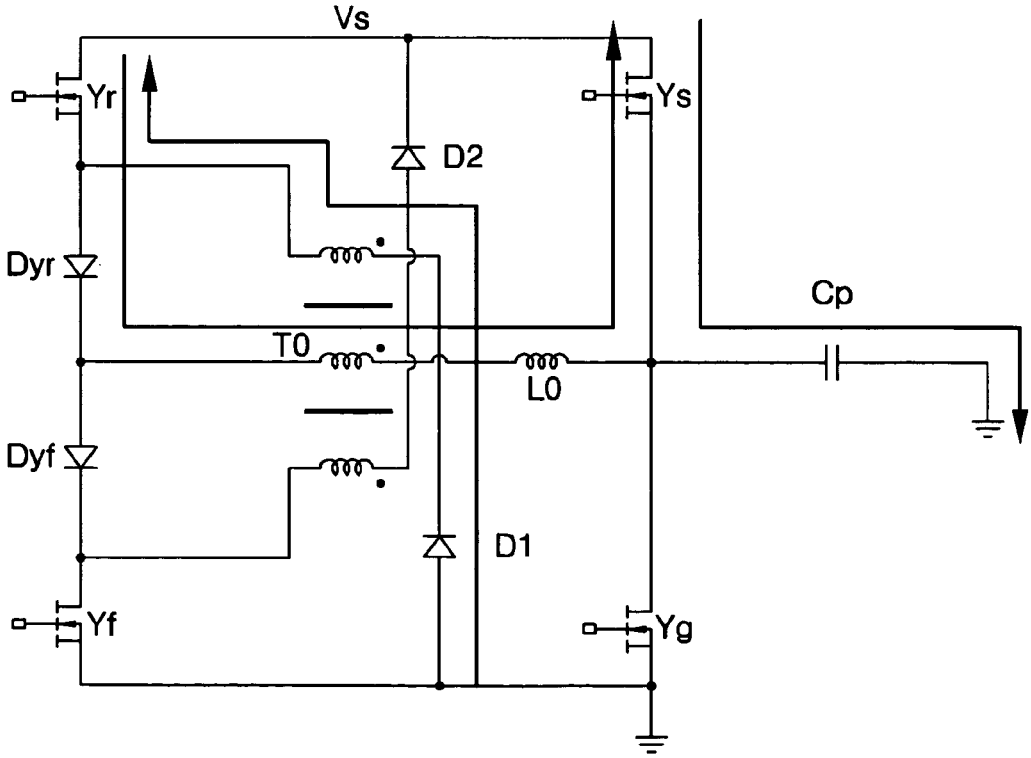

In step 2 (M2), the first switch Ys is turned on in a state that the first controlling switch Yr is maintained to be the turn-on status (ON). Accordingly, the current path is formed from the power source supplying end A to the panel capacitor Cp as passing through the first switch Ys, and the panel voltage Vy rises to the sustain voltage Vs (FIG. 9B).

Here, the resonance current $I_{L1}$ flowing on the resonance inductor L0 flows on the current path formed by the power source supplying end A, the first controlling switch Yr, the diode Dyr, the primary inductor L01 of the transformer T0, the resonance inductor L0, and the first switch Ys. Therefore, a zero voltage switching condition is made on the first switch Ys, the current flowing on the first switch Ys reduces linearly with a slope of (n1*Vs−Vs)/L.

Figure 9C:
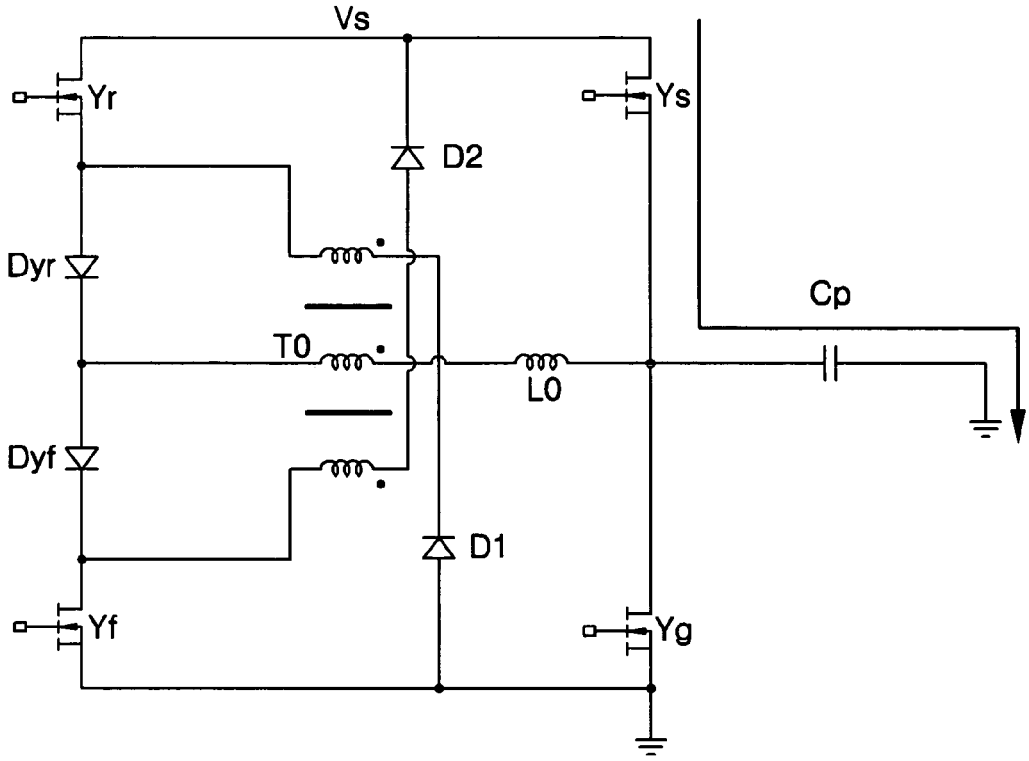

In step 3 (M3), the first controlling switch Yr is turned off (OFF), and the first switch Ys maintains the turned-on (ON) status. Therefore, the transformer T0 is totally reset, and the panel voltage Vy is maintained to be Vs (FIG. 9C).

Figure 9D:
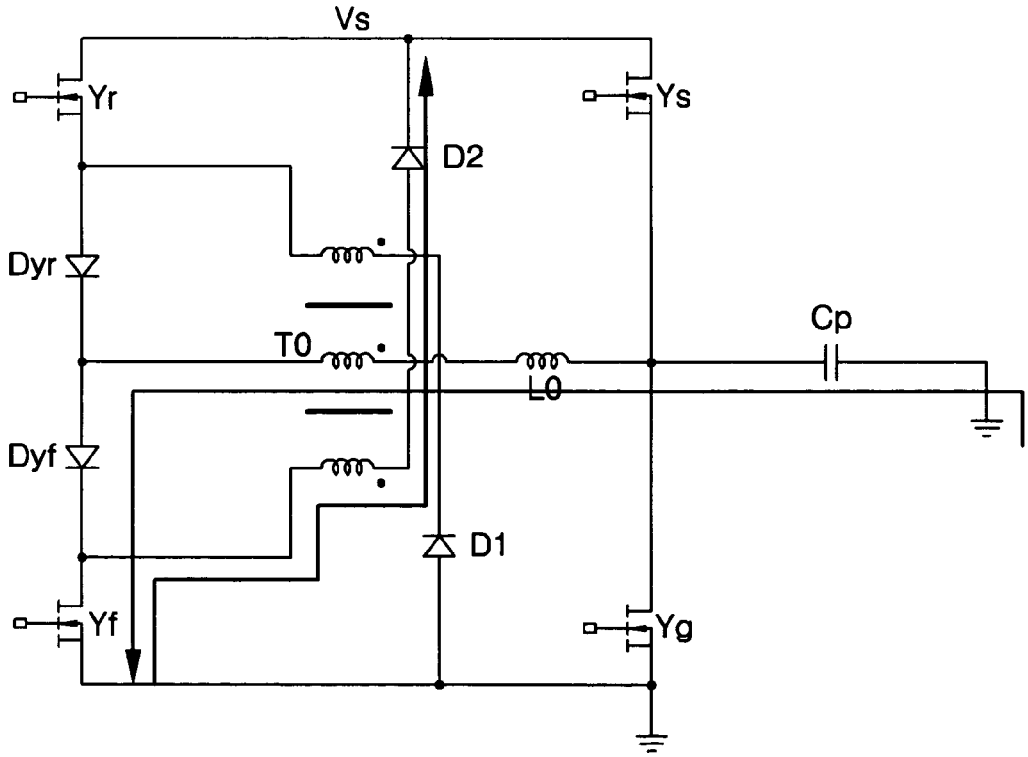

In step 4 (M4), the first switch Ys is turned off (OFF), the second controlling switch Yf is turned on (ON). Accordingly, when the second controlling switch Yf continues to be turned on, Vs voltage is applied to the primary inductor L01 of the transformer T0, and the resonance current $I_{L2}$ flows on the current path formed by the panel capacitor Cp, the resonance inductor L0, the primary inductor L0 of the transformer T0, the diode Dyf, the second controlling switch Yf, and the ground end to recover the charging/discharging energies of the panel capacitor Cp into the power source supplying unit. Here, the panel voltage Vy is descended from Vs to the reference potential (GND) (FIG. 9D).

Accordingly, a voltage of n2*Vs is induced into the secondary inductor L22 of the transformer T0, and the induced current $I_b$ flowing on the secondary inductor L22 flows on the current path formed by the ground end, the second controlling switch Yf, the secondary inductor L22, the diode D2, and the power source supplying end A. Here, since the differential current between the resonance current $I_{L2}$ and the induced current $I_b$ flows on the second controlling switch Yf, the current stress to the second controlling switch Yf is reduced as much as the induced current $I_b$.

Figure 9E:
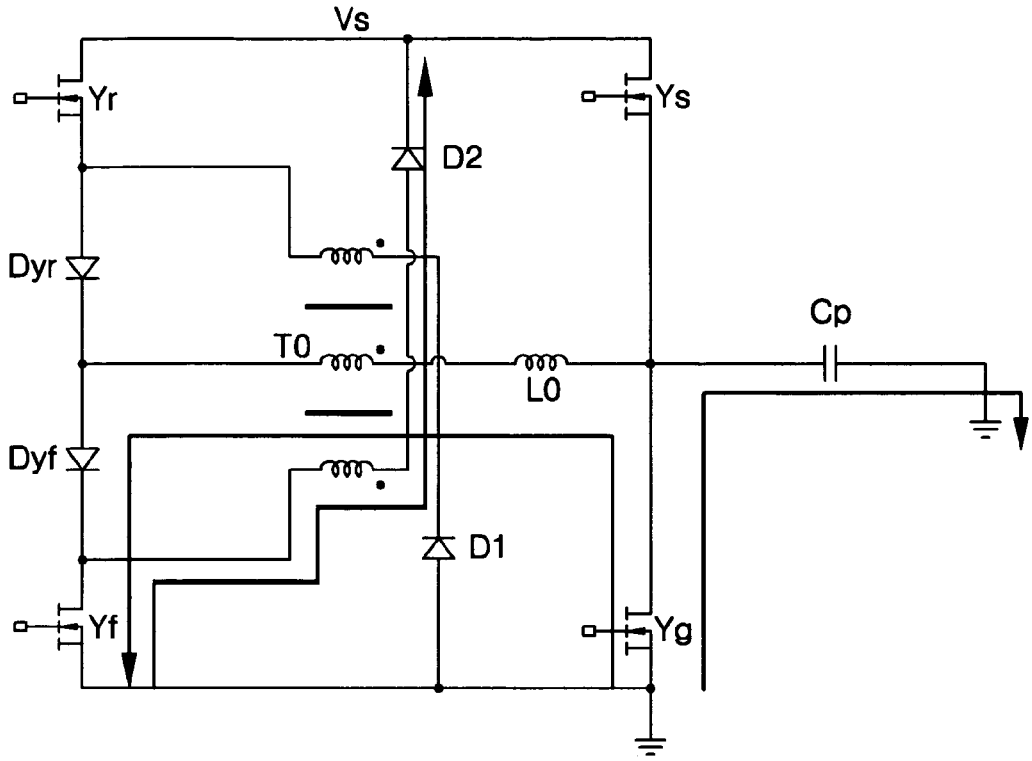

In step 5 (M5), the second controlling switch Yf is maintained to be the turned-on (ON) status, and the second switch Yg is turned on. Accordingly, the current path is formed from the ground end to the panel capacitor Cp as passing through the second switch Yg, and the panel voltage Vy is descended to the reference potential (GND) (FIG. 9E).

Here, the resonance current $I_{L2}$ flowing on the resonance inductor L0 flows on the current path formed by the ground end, the resonance inductor L0, the primary inductor L01 of the transformer T0, the diode Dyf, the second controlling switch Yf, and the ground end. Therefore, the zero voltage switching condition is made on the second switch Yg, the size of the current flowing on the second switch Yg reduces linearly with a slope of n2*Vs/L.

Figure 9F:
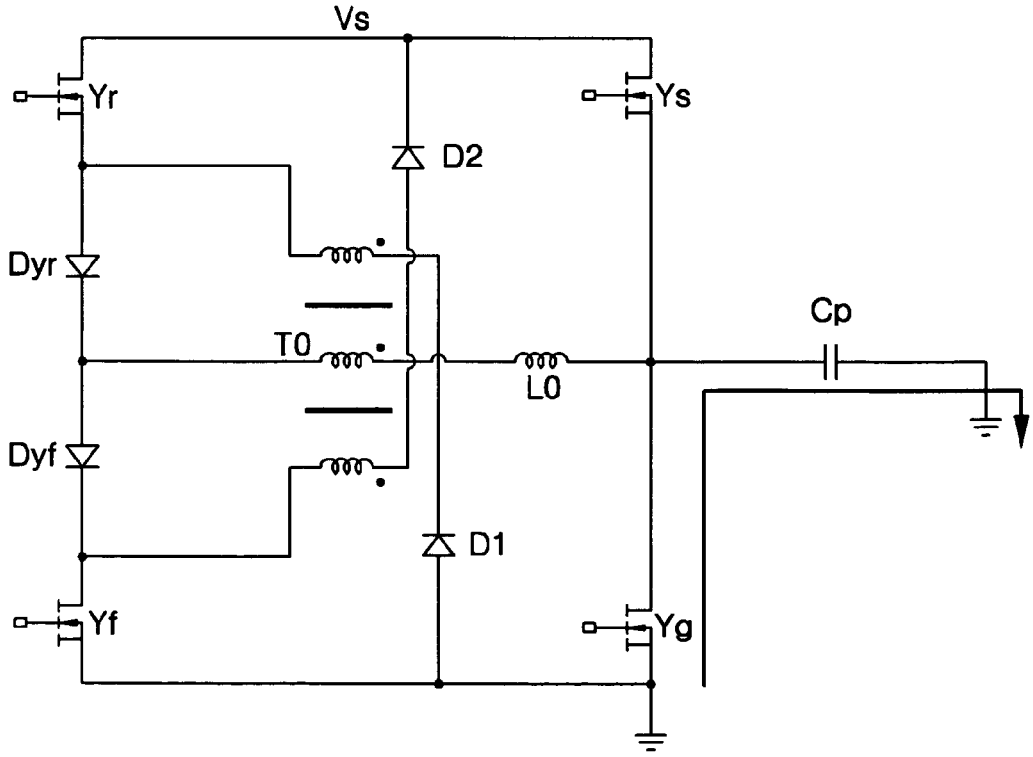

In step 6(M6), the second controlling switch Yf is turned off, and the second switch Yg maintains the turned-on (ON) status. Therefore, the transformer T0 is totally reset, and the panel voltage Vy is maintained to the reference potential (GND) (FIG. 9F).

According to the present invention, in recovering and supplying the charging/discharging energies by operating the controlling switches depending on the charging/discharging operations of the panel capacitor, the charging/discharging currents for recovering and supplying the charging/discharging energies to the controlling switches are flowed by the operations of the controlling switches, and the induced current is flowed on the controlling switches to opposite directions of the charging/discharging currents using the transformer, thus reducing the current stress applied to the controlling switch.

Also, the current stress to the controlling switch for recovering and supplying the charging/discharging energies is reduced using the induced current of the transformer, and therefore, the number of used controlling switches can be reduced and the cost for the energy recovery circuit can be reduced.

Figure 10:
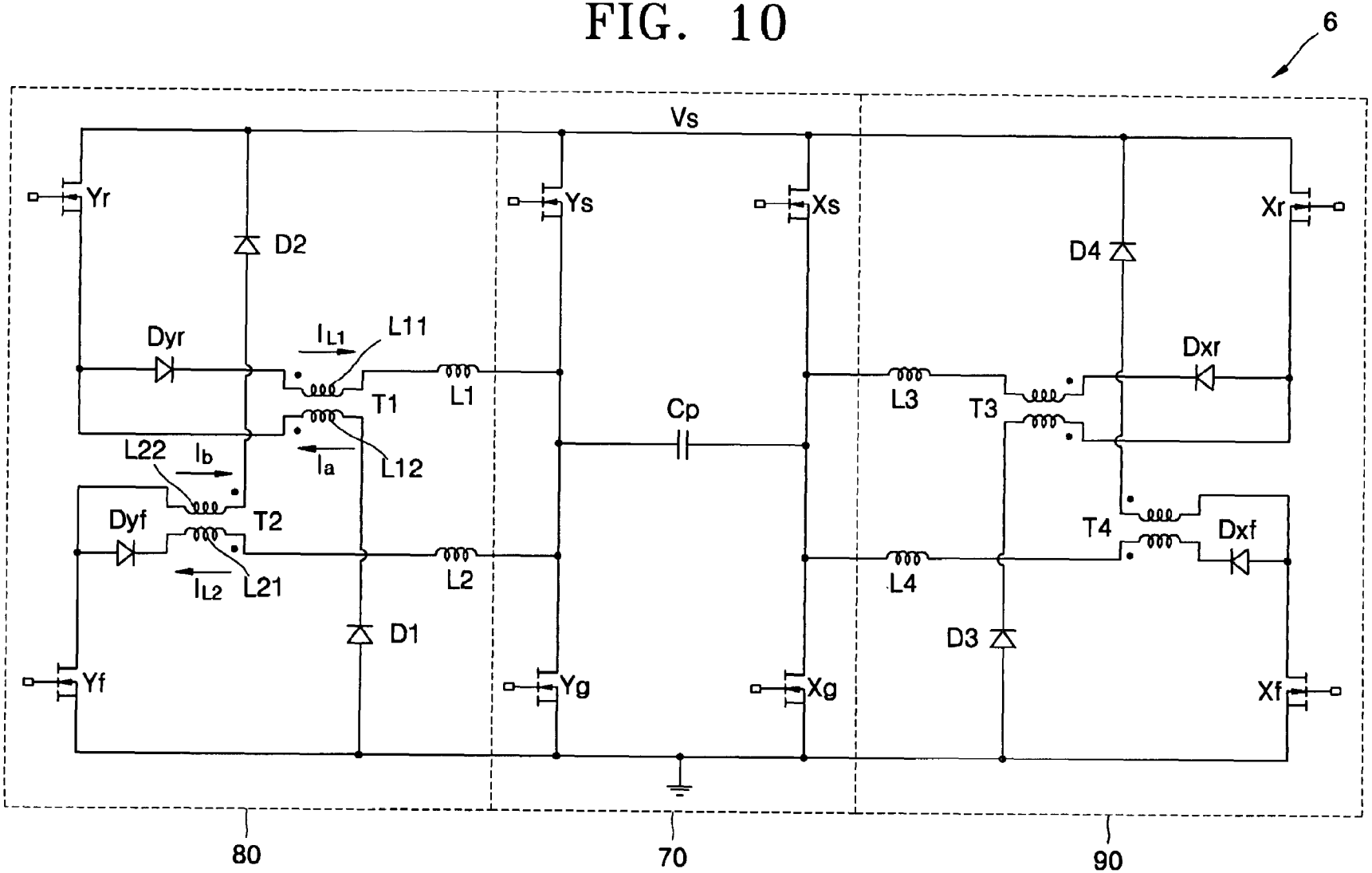
FIG. 10 is a circuit diagram of a driving apparatus of a plasma display panel including the energy recovery circuit according to another embodiment of the present invention.

FIG. 10 is a circuit diagram of a driving apparatus for the plasma display panel including the energy recovery circuit according to another embodiment of the present invention.

The driving apparatus 6 of the plasma display panel includes a sustain driving unit 70, a first energy recovery circuit 80, and a second energy recovery circuit 90. The first energy recovery circuit 80 is connected to the Y-driving unit, and the second energy recovery circuit is connected to the X-driving unit. Also, the plasma display panel driving apparatus 6 is operated in the way shown in FIGS. 8, and 9A, 9B, 9C, 9D, 9E and 9F.

Referring to FIG. 10, it is desirable that the transformer includes a first transformer T1 and a second transformer T2. The first transformer T1 is connected between the first controlling switch Yr and the panel capacitor Cp to reduce the current $I_{yr}$ flowing on the first controlling switch Yr. The second transformer T2 is connected between the second controlling switch Yf and the panel capacitor Cp to reduce the current $I_{yf}$ flowing on the second controlling switch Yf.

It is desirable that the resonance inductor includes a first resonance inductor L1 and a second resonance inductor L2. The first resonance inductor L1 is connected between the panel capacitor Cp and the first transformer T1 to form a supplying path of the charging/discharging energies. The second resonance inductor L2 is connected between the panel capacitor Cp and the second transformer T2 to form a recovery path of the charging/discharging energies.

One end of the first controlling switch Yr is connected to the power source supplying end A of the power source supplying unit, and the other end of the first controlling switch Yr is connected to one end of the primary inductor L11 of the first transformer T1. The other end of the primary inductor L 11 of the first transformer T1 is connected to one end of the first resonance inductor L 1, and the other end of the first resonance inductor L1 is connected to the panel capacitor Cp. One end of the secondary inductor L12 of the first transformer T1 is connected to the other end of the first controlling switch Yr, and the other end of the secondary inductor L12 is grounded to the reference potential through the diode D1.

One end of the second controlling switch Yf is connected to the ground end of the power source supplying unit, and the other end of the second controlling switch Yf is connected to one end of the primary inductor L21 of the second transformer T2. The other end of the primary inductor L21 of the second transformer T2 is connected to one end of the second resonance inductor L2, and the other end of the second resonance inductor L2 is connected to the panel capacitor Cp. One end of the secondary inductor L22 of the second transformer T2 is connected to the other end of the second controlling switch Yf, and the other end of the secondary inductor L22 is connected to the power source supplying end through the diode D2.

According to the energy recovery circuit of the plasma display panel and the driving apparatus of the plasma display panel including the energy recovery circuit of the present invention, in recovering and supplying the charging/discharging energies by operating the controlling switches based on the charging/discharging operations of the panel capacitor, the charging/discharging currents for recovering and supplying the charging/discharging energies to the controlling switches flow by the operations of the controlling switches, and the induced current also flows on the controlling switches to opposite directions of the charging/discharging currents using the transformer. This reduces the current stress applied to the controlling switch.

Also, the current stress applied to the controlling switch for recovering and supplying the charging/discharging energies is reduced using the induced current of the transformer, and therefore, the number of used controlling switches can be reduced and the cost for the energy recovery circuit can be reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An energy recovery circuit of a plasma display panel including X-electrode lines and Y-electrode lines formed alternately side by side, discharging cells formed on areas where the X-electrode lines and the Y-electrode lines and address electrode lines cross each other, and a panel capacitor formed between the electrode lines, said energy recovery circuit comprising:

a first controlling switch connected between the panel capacitor and a power source supplying unit and switched according to an external control signal to control the energy recovered in the power source supplying unit to be supplied to the panel capacitor; and a second controlling switch connected between the panel capacitor and the power source supplying unit and switched according to an external control signal to control the energy recovery from the panel capacitor to the power source supplying unit;

a transformer connected between the first controlling switch and the second controlling switch and the panel capacitor so that resonance current flows on a primary inductor by the first controlling switch and the second controlling switch, and induced current induced by the resonance current flowing on a secondary inductor flows to a direction compensating the resonance current through the first controlling switch and the second controlling switch.

2. The energy recovery circuit of claim 1, wherein the transformer includes a first transformer connected between the first controlling switch and the panel capacitor to reduce current flow on the first controlling switch, and a second transformer connected between the second controlling switch and the panel capacitor to reduce current flow on the second controlling switch.

3. The energy recovery circuit of claim 2, further comprising:

a first resonance inductor connected between the panel capacitor and the first transformer to form a supply path of the charging/discharging energies; and a second resonance inductor connected between the panel capacitor and the second transformer to form a recovery circuit of the charging/discharging energies.

4. The energy recovery circuit of claim 3, wherein one end of the first controlling switch is connected to a power source supplying end of the power source supplying unit and the other end of the first controlling switch is connected to one end of a first primary inductor of the first transformer, the other end of the first primary inductor of the first transformer is connected to one end of the first resonance inductor, the other end of the primary resonance inductor is connected to the panel capacitor, one end of a first secondary inductor of the first transformer is connected to the other end of the first controlling switch, and the other end of the first secondary inductor is grounded through a first diode.

5. The energy recovery circuit of claim 4, wherein one end of the second controlling switch is connected to a ground end of the power source supplying unit and the other end of the second controlling switch is connected to one end of a second primary inductor of the second transformer, the other end of the second primary inductor of the second transformer is connected to one end of the second resonance inductor, the other end of the second resonance inductor is connected to the panel capacitor, one end of a second secondary inductor of the second transformer is connected to the other end of the second controlling switch, and the other end of the second secondary inductor is connected to the power source supplying end through a second diode.

6. The energy recovery circuit of claim 5, wherein the first resonance inductor and the second resonance inductor use a common inductor, and the first primary inductor of the first transformer and the second primary inductor of the second transformer use a common inductor to form a transformer with the first secondary inductor of the first transformer and the second secondary inductor of the second transformer.

7. A driving apparatus of a plasma display panel including X-electrode lines and Y-electrode lines formed alternately side by side, discharge cells formed on areas where the X-electrode lines and the Y-electrode lines and address electrode lines cross each other, and a panel capacitor formed between the electrode lines, comprising:

a sustain driving unit, of which one end is connected to a power source supplying end of the power source supplying unit, switched by an external control signal to supply sustain voltage to the panel capacitor so as to sustain the display panel and to discharge the charged power periodically; and an energy recovery circuit including a first controlling switch connected between the panel capacitor and the power source supplying unit and switched according to an external control signal to control the energy recovered in the power source supplying unit to be supplied to the panel capacitor, a second controlling switch connected between the panel capacitor and the power source supplying unit and switched according to an external control signal to control the energy recovery from the panel capacitor to the power source supplying unit, and a transformer connected between the first controlling switch and the second controlling switch and the panel capacitor so that resonance current flows on a primary inductor by the first controlling switch and the second controlling switch, and induced current induced by the resonance current flowing on a secondary inductor flows to a direction compensating the resonance current through the first controlling switch and the second controlling switch.

8. The driving apparatus of claim 7, wherein the energy recovery circuit includes a first energy recovery circuit and a second energy recovery circuit that are connected to both ends of the panel capacitor symmetrically.

9. The driving apparatus of claim 7, wherein the sustain driving unit includes a first switch and a second switch connected to each other at each of their ends and commonly connected to the Y-electrode lines, and a third switch and a fourth switch connected to each other at each of their ends and commonly connected to the X-electrode lines.

10. The driving apparatus of claim 7, wherein the transformer includes a first transformer connected between the first controlling switch and the panel capacitor for reducing current flowing on the first controlling switch, and a second transformer connected between the second controlling switch and the panel capacitor for reducing current flowing on the second controlling switch.

11. The driving apparatus of claim 10, further comprising:

a first resonance inductor connected between the panel capacitor and the first transformer for forming a supply path of the charging/discharging energies; and a second resonance inductor connected between the panel capacitor and the second transformer for forming a recovery circuit of the charging/discharging energies.

12. The driving apparatus of claim 11, wherein one end of the first controlling switch is connected to a power source supplying end of the power source supplying unit and the other end of the first controlling switch is connected to one end of a first primary inductor of the first transformer, the other end of the first primary inductor of the first transformer is connected to one end of the first resonance inductor, the other end of the primary resonance inductor is connected to the panel capacitor, one end of a first secondary inductor of the first transformer is connected to the other end of the first controlling switch, and the other end of the secondary inductor is grounded through a first diode.

13. The driving apparatus of claim 12, wherein one end of the second controlling switch is connected to a ground end of the power source supplying unit and the other end of the second controlling switch is connected to one end of a second primary inductor of the second transformer, the other end of the second primary inductor of the second transformer is connected to one end of the second resonance inductor, the other end of the second resonance inductor is connected to the panel capacitor, one end of a second secondary inductor of the second transformer is connected to the other end of the second controlling switch, and the other end of the second secondary inductor is connected to the power source supplying end through a second diode.

14. The driving apparatus of claim 13, wherein the first resonance inductor and the second resonance inductor use a common inductor, and the first primary inductor of the first transformer and the second primary inductor of the second transformer use a common inductor to form a transformer with the first secondary inductor of the first transformer and the second secondary inductor of the second transformer.

* * * * *